US007278367B1

(12) United States Patent
Gonring et al.

(10) Patent No.: US 7,278,367 B1
(45) Date of Patent: Oct. 9, 2007

(54) MARINE VESSEL STEERING WHEEL WITH INTEGRATED THROTTLE CONTROL DEVICE

(75) Inventors: Steven J. Gonring, Slinger, WI (US); Bruce A. Heidel, Fond du Lac, WI (US); Claus Bruestle, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 156 days.

(21) Appl. No.: 11/174,933

(22) Filed: Jul. 5, 2005

(51) Int. Cl.
*B63H 25/04* (2006.01)

(52) U.S. Cl. ..... 114/144 R; 74/492; 200/61.57

(58) Field of Classification Search ..... 114/144 R; 74/491, 492; 200/61.54, 61.55, 61.56, 61.57
See application file for complete search history.

(56) References Cited

U.S. PATENT DOCUMENTS

| | | | | |
|---|---|---|---|---|
| 1,500,191 | A * | 7/1924 | Herbert | 200/61.57 |
| 1,740,634 | A * | 12/1929 | Wettlaufer | 200/61.57 |
| 2,793,262 | A * | 5/1957 | Albert | 200/61.57 |
| 4,421,960 | A | 12/1983 | Arima et al. | 200/61.54 |
| 4,578,592 | A | 3/1986 | Nakazawa et al. | 307/10 R |
| 4,638,131 | A | 1/1987 | Kidd et al. | 200/61.55 |
| 5,085,461 | A | 2/1992 | Shibata | 280/731 |
| 5,337,694 | A * | 8/1994 | Nix et al. | 114/144 R |
| 5,707,262 | A * | 1/1998 | Huntley et al. | 114/144 R |
| 5,855,144 | A * | 1/1999 | Parada | 200/61.57 |
| D419,507 | S | 1/2000 | Triarsi et al. | D12/176 |
| 6,034,600 | A | 3/2000 | Browne et al. | 340/475 |
| 6,268,576 | B1 | 7/2001 | Onodera | 200/61.54 |
| 6,273,771 | B1 | 8/2001 | Buckley et al. | 440/84 |
| 6,414,607 | B1 | 7/2002 | Gonring et al. | 341/20 |
| 6,546,829 | B1 | 4/2003 | Despreaux | 74/558 |
| 6,624,365 | B2 | 9/2003 | Miyako et al. | 200/61.54 |
| 6,768,067 | B2 | 7/2004 | Adachi et al. | 200/61.54 |
| 6,852,936 | B2 | 2/2005 | Hayashi et al. | 200/61.54 |
| 2006/0054479 | A1 * | 3/2006 | Iisaka et al. | 200/61.57 |

FOREIGN PATENT DOCUMENTS

| | | | |
|---|---|---|---|
| JP | 2002-166831 | * | 6/2002 |

* cited by examiner

*Primary Examiner*—Lars A. Olson
(74) *Attorney, Agent, or Firm*—William D. Lanyi

(57) ABSTRACT

A steering wheel provides a control device that is easily maneuverable, by one hand, by an operator who is gripping the rim of the steering wheel. Release of the rim is not necessary to affect a change in the control parameter of an engine or other element of a marine vessel through use of the control device. The control device is rotatable about an axis of rotation which is generally parallel to a line which is tangent to a centerline of the rim of the steering wheel.

11 Claims, 4 Drawing Sheets

MARINE VESSEL STEERING WHEEL WITH INTEGRATED THROTTLE CONTROL DEVICE

BACKGROUND OF THE INVENTION

1. Field of the Invention

The present invention is generally related to a steering wheel for a marine vessel and, more particularly, to a steering wheel which comprises an integral control device formed within its rim.

2. Description of the Related Art

Many different types of steering wheels are known to those skilled in the art. In addition, various types of control devices can be used in conjunction with the steering wheels. Furthermore, various types of communication bus arrangements are also known to those skilled in the art.

U.S. Pat. No. 4,421,960, which issued to Arima et al. on Dec. 20, 1983, describes a steering wheel with a switch assembly. A switch support structure is positioned internally of the rim portion of a steering wheel and has incorporated therein a switch assembly including various electric switch units to be manually actuated. It is retained in position independently of the steering wheel and held against rotation with respect to a steering column tube fixed with respect to the body structure of the vehicle and wherein an optical display unit is associated with the switch units or some of the switch units and is securely supported in position in front of the steering wheel.

U.S. Pat. No. 4,578,592, which issued to Nakazawa et al. on Mar. 25, 1986, describes a steering wheel assembly with a centralized control system. It includes a terminal component such as an input and output member disposed in a center pad of the steering wheel. The terminal component and a computer for controlling the terminal component are disposed at a center pad of the steering wheel, the terminal component being mounted to the center pad in a selectively exchangeable manner.

U.S. Pat. No. 4,638,131, which issued to Kidd et al. on Jan. 20, 1987, describes a steering wheel pad keyboard switch assembly. The assembly is mounted on a steering wheel. The preassembled switch assembly comprises a base, a printed circuit board which has an array of open contact grids, an elastomeric switch member which has an array of movable contacts, a guide plate and a push button subassembly. The guide plate has a plurality of guide bosses and guide holes disposed in the same predetermined array for guiding the stem pieces of push buttons into operative contact with the movable contacts of the switch member and a pad portion for supporting a horn switch. The push button subassembly comprises a frame member which is attached to the base to provide the unit handle switch assembly, a plurality of push buttons which are slidably retained in respective slide chambers of the frame and a soft decorative cover which includes a depressable horn switch pad to operate the horn switch and cutouts to provide access to the push buttons. The guide plate and the stem pieces of the push buttons are made of a translucent material and form part of the back lighting system for the push buttons legend.

U.S. Pat. No. 5,085,461, which issued to Shibata on Feb. 4, 1992, describes an air bag mount device for steering wheel including control switches. It comprises an inflatable air bag body in the air bag unit, an air bag cover provided in the air bag unit for covering the air bag body, a bag storing portion provided in the air bag unit for receiving the air bag body, and a control switch for controlling accessories mounted on a vehicle.

U.S. Pat. D419,507, which issued to Triarsi et al. on Jan. 25, 2000, is a design patent that shows various configurations of a steering wheel having push button shifters.

U.S. Pat. No. 6,034,600, which issued to Browne et al. on Mar. 7, 2000, describes a turn signal system and method with steering wheel mounted control of conventional and lane shift indications. It utilizes turn selectors located on a steering wheel. The system has right and left turn signal indicator circuits that are each energizable to indicate an intended movement of the vehicle toward the right or left, respectively. A microcontroller controls the energization of the right and left indicator circuits. Each of the right and left selectors is actuatable in a first manner for causing the microcontroller to energize the respective indicator circuit to perform a first indication operation and actuatable in a second manner for causing the microcontroller to energize the respective indicator circuit to perform a second indication operation.

U.S. Pat. No. 6,268,576, which issued to Onodera on Jul. 31, 2001, describes a switch apparatus for a steering wheel. The switch apparatus is constructed such that a switch body section is mounted within a pad section of a steering wheel, an operating section for driving the switch body section is caused to protrude outwardly of the pad section, and it is made possible to operate the operating section from two directions in such a manner that the same switch signal can be outputted in the operation from either direction.

U.S. Pat. No. 6,273,771, which issued to Buckley et al. on Aug. 14, 2001, discloses a control system for a marine vessel. The control system incorporates a marine propulsion system that can be attached to a marine vessel and connected in signal communication with a serial communication bus and a controller. A plurality of input devices and output devices are also connected in signal communication with a communication bus and a bus access manager, such as a CAN Kingdom network, is connected in signal communication with the controller to regulate the incorporation of additional devices to the plurality of devices in signal communication with the bus, whereby the controller is connected in signal communication with each of the plurality of devices on the communication bus.

U.S. Pat. No. 6,414,607, which issued to Gonring et al. on Jul. 2, 2002, discloses a throttle position sensor with an improved redundancy and high resolution. The sensor is provided with a plurality of sensing elements which allow the throttle position sensor to provide a high resolution output to measure the to physical position of a manually movable member, such as a throttle handle, more accurately than would otherwise be possible. The plurality of sensors significantly increases the redundancy of the sensor and allows its operation even if one of the sensing elements is disabled.

U.S. Pat. No. 6,546,829, which issued to Despreaux on Apr. 15, 2003, describes a marine steering wheel assembly. It includes a support frame having a preferably annular configuration and further including at least one wheel section. Each wheel section comprises two segments connected to one another and the support frame. Each of the two segments of each wheel section are independently formed to include any one of a plurality of predetermined, decorative surface finishes and are secured to the support frame subsequent to the surface finishing thereof.

U.S. Pat. No. 6,624,365, which issued to Miyako et al. on Sep. 23, 2003, describes a structure for mounting a switch on a vehicular steering wheel. An outer casing of a switch is provided with mounting hooks which are engaged with a core metal of a steering wheel. A lower cover of the steering wheel is provided with retaining portions which are made to abut against the mounting hooks in such a way as to restrain the retaining portions from moving in a direction in which the engagement between the core metal and each of the retaining portions is canceled.

U.S. Pat. No. 6,768,067, which issued to Adachi et al. on Jul. 27, 2004, describes a switch device in a steering wheel. It includes a front switch assembly and a back switch. The front switch assembly is provided on a front side of the steering wheel that faces the driver and rotates integrally with the steering wheel. The back switch is provided on a back side of the steering wheel. The front switch assembly includes at least one front switch.

U.S. Pat. No. 6,852,936, which issued to Hayashi et al. on Feb. 8, 2005, describes a switch structure of a steering wheel. It provides a switch structure of a steering wheel at which a pair of opening portions symmetrically formed between an inner periphery of a rim of the steering wheel and an outer periphery of a pad cover, as seen from a vehicle occupant side, at each of which opening portions a switch assembly is formed by a plurality of switches. Arrangement and shape of the plurality of switches constituting each switch assembly are determined so as to be symmetrical with respect to a predetermined base line intersecting the respective opening portions.

The patents described above are hereby expressly incorporated by reference in the description of the present invention.

It would be significantly beneficial if a steering wheel for a marine vessel could be provided in which an operation parameter of the marine vessel could be affected through use of the operator's fingers or grip without requiring that the operator release the rim of the steering wheel.

SUMMARY OF THE INVENTION

A steering wheel for a marine vessel, made in accordance with a preferred embodiment of the present invention, comprises a hub which is attachable to a steering column of a marine vessel, a rim which is attached to the hub, and a control device that is movably attached to the rim. The control device is configured to provide a signal which is representative of an operational parameter of the marine vessel.

The control device can be rotatably attached to the rim and, furthermore, in a preferred embodiment of the present invention, can be rotatable about an axis of rotation which extends through the rim. This axis of rotation is generally parallel to a line which is tangent to a center line of the rim in a region where the control device is attached to the steering wheel.

Although various types of control devices can be used in accordance with a preferred embodiment of the present invention, the control device in a preferred embodiment of the present invention can be a throttle control device and it can comprise a potentiometer.

The system can further comprise a communication bus connected in signal communication between the control device on the steering wheel and a computer controlled actuator which is configured to affect the operational parameter of the marine vessel. An information display device is attached to the hub in one embodiment of the present invention and can be configured to display information relating to the operational parameter of the marine vessel. Although a preferred embodiment of the present invention incorporates a generally circular rim of the steering wheel, alternative shapes are also possible within its scope. The control device can be configured to return to a central position unless a force is exerted to move the control device away from the central position. If the control device is a throttle control mechanism, it can be configured to return to the central position if the operator releases the control device and ceases to exert a force on it to move it away from the central position.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
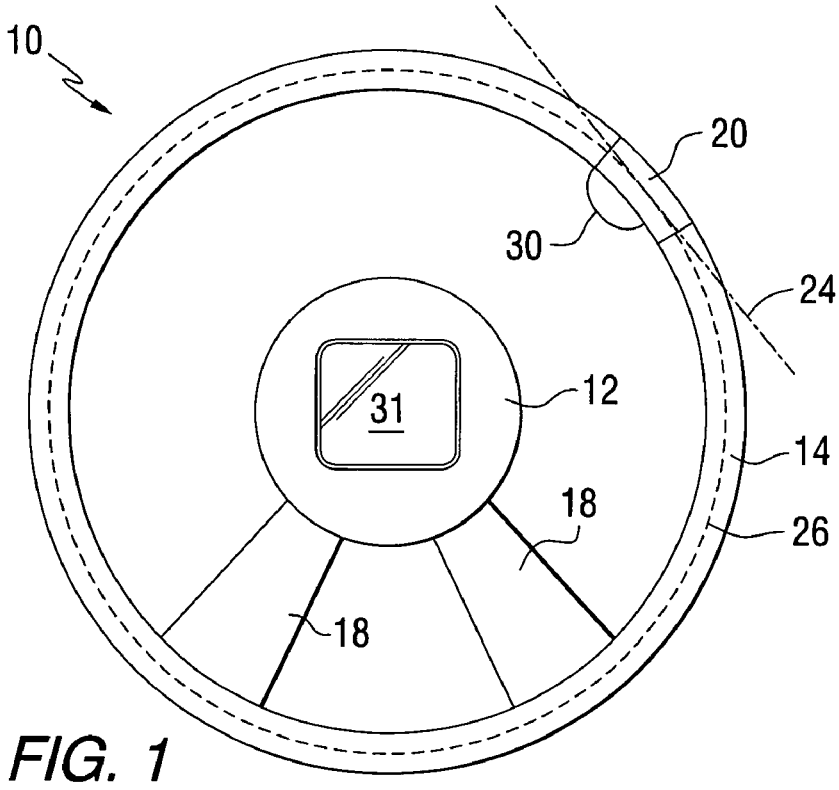
FIG. 1 is a simplified schematic representation of a steering wheel incorporating the principles of a preferred embodiment of the present invention.

Throughout the description of the preferred embodiment of the present invention, like components will be identified by like reference numerals.

FIG. 1 is a simplified representation of a steering wheel 10 for a marine vessel. It comprises a hub 12 which is attachable to a steering column of the marine vessel, as will be described below in conjunction with FIG. 5.

With continued reference to FIG. 1, the steering wheel also comprises a rim 14 which is attached to the hub 12. The attachment in FIG. 1 is provided by two structural members 18, but it should be understood that many different types of connection techniques are known to those skilled in the art for attaching a rim 14 to a hub 12. A control device 20 is movably attached to the rim 14. The control device is configured to provide a signal, as will be described in greater detail below, which is representative of an operational parameter of the marine vessel. In one embodiment of the present invention, the control device can be a throttle control device by which the operator of the marine vessel can selectively change the operating speed of the engine of a marine propulsion system without removing the operator's hand from the rim 14.

The embodiment shown in FIG. 1 illustrates the control device 20 being rotatably attached to the rim 14. It is rotatable about an axis of rotation 24 which extends through the rim as shown. The axis of rotation is generally parallel to a line which is tangent to a centerline 26 of the rim 14 within the region where the control device 20 is attached to the steering wheel 10. The control device 20 shown in FIG. 1 is provided with a surface 30 which is easily accessible to the thumb of the marine vessel operator so that the control device 20 can be rotated about its axis of rotation 24 by simply exerting a force, with the operator's thumb, to cause the control device 20 to rotate about axis 24.

With continued reference to FIG. 1, the control device 20 can be a throttle control device by which the operator can change the operating speed of the engine of a marine propulsion system. It can comprise a potentiometer which can be configured according to the disclosure contained in U.S. Pat. No. 6,414,607.

In one embodiment of the present invention, the system further comprises a communication bus connected in signal communication between the control device 20 and an actuator which is configured to affect the operational parameter of the marine vessel. The communication bus can be configured in a manner generally similar to that disclosed in U.S. Pat. No. 6,273,771. Although not shown in FIG. 1, it should be understood that the actuator can be any actuator necessary to respond to the signals provided by the control device 20. In other words, a stepper motor can respond to the signals from the control device 20 and move a throttle plate to appropriately affect the operating speed of the engine. Alternatively, a signal can be provided from the control device 20 to a microprocessor which, in turn, controls the operating speed of the engine. Similarly, various types of stepper motors or hydraulic actuators can be configured to respond to signals from a control device 20 for the purpose of affecting the position of a trim tab, or other device, of the marine vessel.

With continued reference to FIG. 1, an information display device can be incorporated into the steering wheel 10. The information display device 31 is illustrated in FIG. 1 as being incorporated into the hub 12 of the steering wheel 10. The information display device 31 can be configured to display information relating to the operational parameter affected by the control device 20 or, alternatively, any other information relating to the operation of the marine vessel. The steering wheel 10 in FIG. 1 incorporates a generally circular rim 14 which has a centerline 26 that is also generally circular. However, it should be understood that the circular characteristic of the rim 14 is not a requirement in all embodiments of the present invention.

Figure 2:
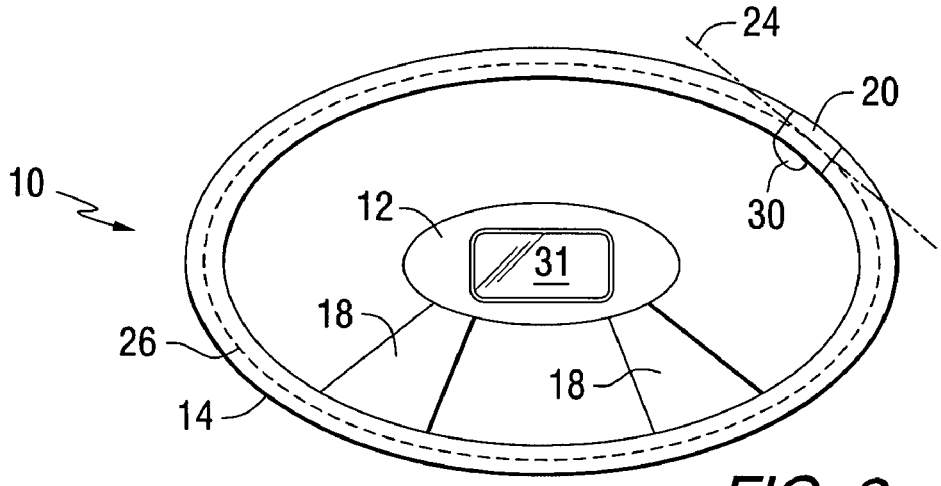
FIG. 2 shows an alternative embodiment of a preferred embodiment of the present invention.

FIG. 2 shows a generally oval rim 14 attached to the hub 12 of the steering wheel 10. The control device 20 remains rotatable about its axis of rotation 24 which, as described above, is preferably generally parallel to a line which is tangent to a centerline of the rim 14 within the region where the control device 20 is attached to the steering wheel 10.

Figure 3:
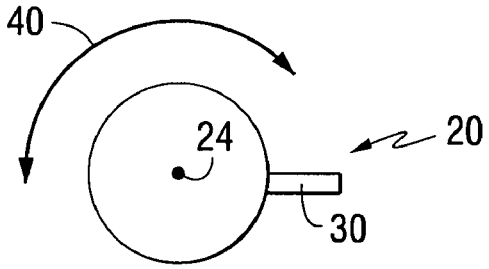
FIG. 3 is a section view of a control device.

FIG. 3 is a section view taken through the control device 20 in a direction perpendicular to its axis of rotation 24. The surface 30, which is intended to be moved when the operator exerts thumb pressure to rotate the control device 20 about its axis of rotation 24, is shown extending radially outwardly from the control device 20. It should be understood that alternative configurations of this control surface 30 are also within its scope.

In addition, a hand gripped device, similar to a throttle grip of a motorcycle, an replace the system in FIGS. 1 and 2 in alternative embodiments of the present invention. The arrow 40 in FIG. 3 shows that the control device 20 is rotatable in both directions about the axis of rotation 24. In a preferred embodiment, the control device 20 is spring loaded to return to a central position when the operator releases pressure from surface 30. In other words, if the operator releases the control device 20, it will automatically return to a lowest engine speed command position. This is not a requirement in all embodiments of the present invention, but is incorporated in a preferred embodiment.

Figure 4:
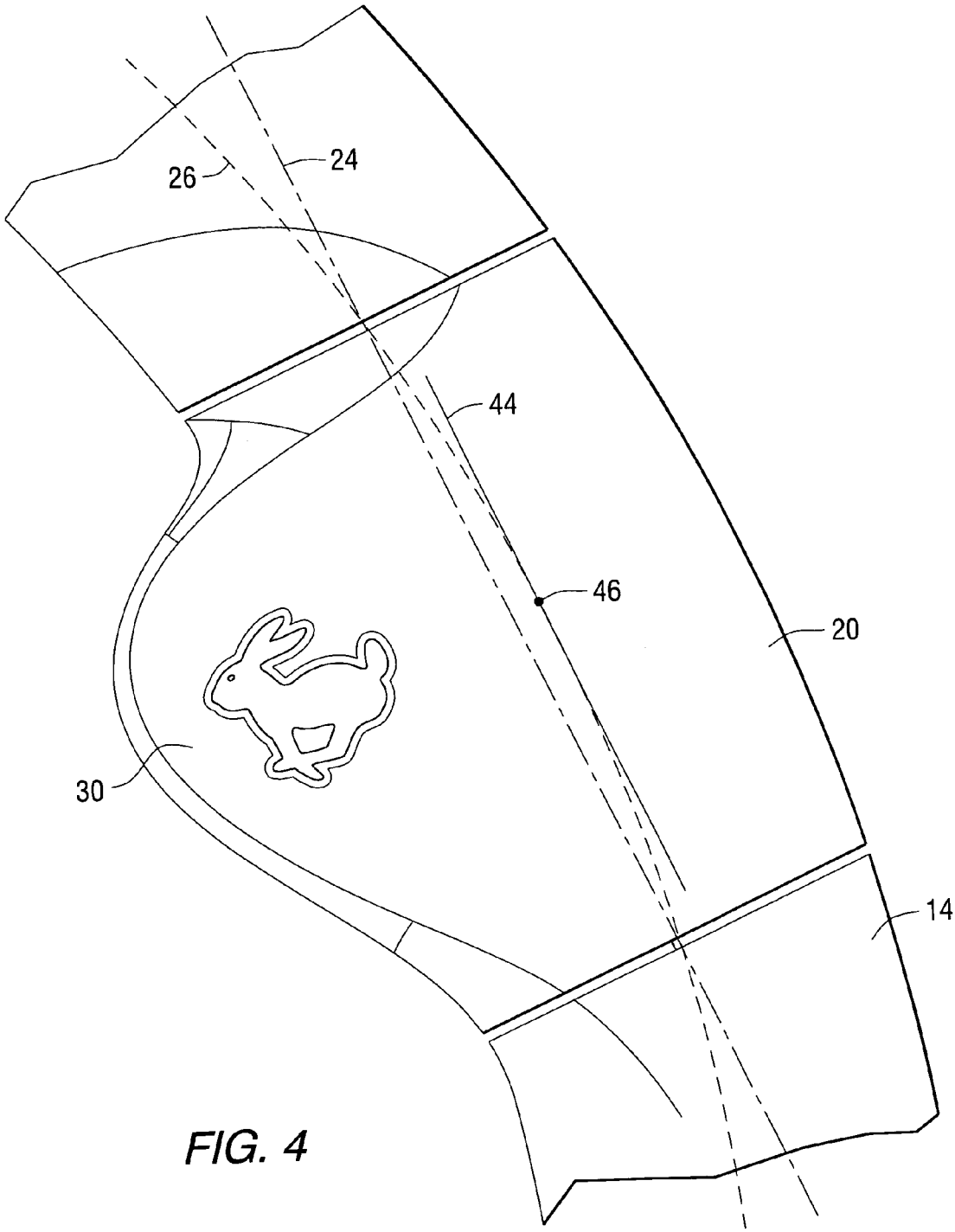
FIG. 4 illustrates the relationship of various axes and lines associated with the preferred embodiment of the present invention.

FIG. 4 shows the control device 20 with its axis of rotation 24 shown in association with the centerline 26 of the rim. Although the precise positions of the axis of rotation 24 relative to the centerline 26 are not limiting in all embodiments of the present invention, the axis of rotation 24 is preferably configured to be parallel to a line 44 which is tangent (e.g. at point 46) to the centerline 26 of the rim 14 in the region where the control device 20 is attached to the steering wheel 10. In other words, as illustrated in FIG. 4, lines 44 and 24 are parallel to each other, line 44 is tangent to centerline 26 at point 46, and this tangency is within the region of the control device 20.

Figure 5:
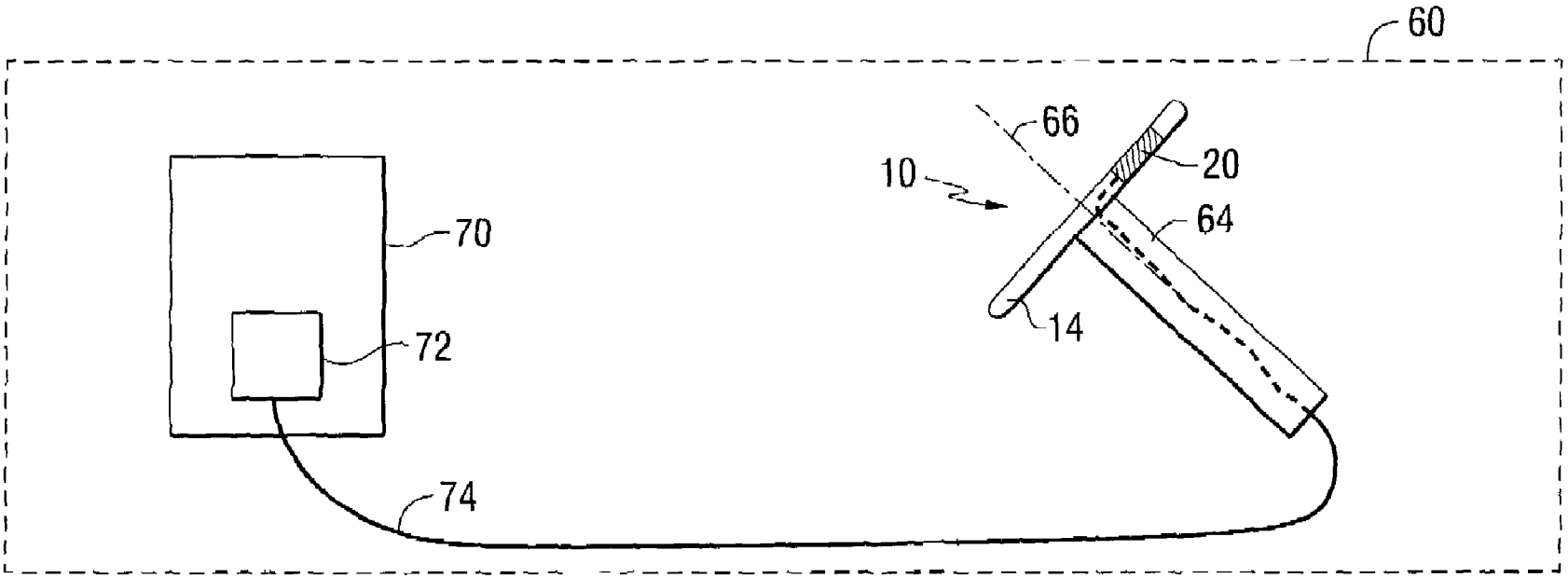
FIG. 5 shows a highly simplified schematic representation of a marine vessel incorporating a preferred embodiment of the present invention.

FIG. 5 is the simplified schematic representation of a marine vessel 60 with which the steering wheel 10 is used. The steering wheel 10 is attachable to a steering column 64 which is generally rotatable about an axis of rotation 66. The location of the control device 20 is illustrated in FIG. 5 and it is intended to represent a control device 20 which operates according to the principles described above in conjunction with FIGS. 1-4. A marine propulsion system 70, such as an outboard motor or an engine of a sterndrive marine propulsion system, is provided with a microprocessor 72 which operates as an engine control module for the marine propulsion system. The microprocessor 72 is shown connected in electrical communication, by a bus 74, to the control device 20. Signals provided by the control device 20 are received by the microprocessor 72 and appropriate changes, in a manner well known to those skilled in the art, are made to an operational parameter of the marine vessel 60 in response to those signals. In other words, if the control device 20 is a throttle control mechanism, it provides similar signals to those normally provided by a hand operated throttle handle, of the conventional type, which is used in a digital throttle and shift system. The primary difference is that the control device 20 of the preferred embodiment of the present invention is incorporated as part of a rim 14 of a steering wheel 10 and not located at a separate location from the steering wheel.

Figure 6:
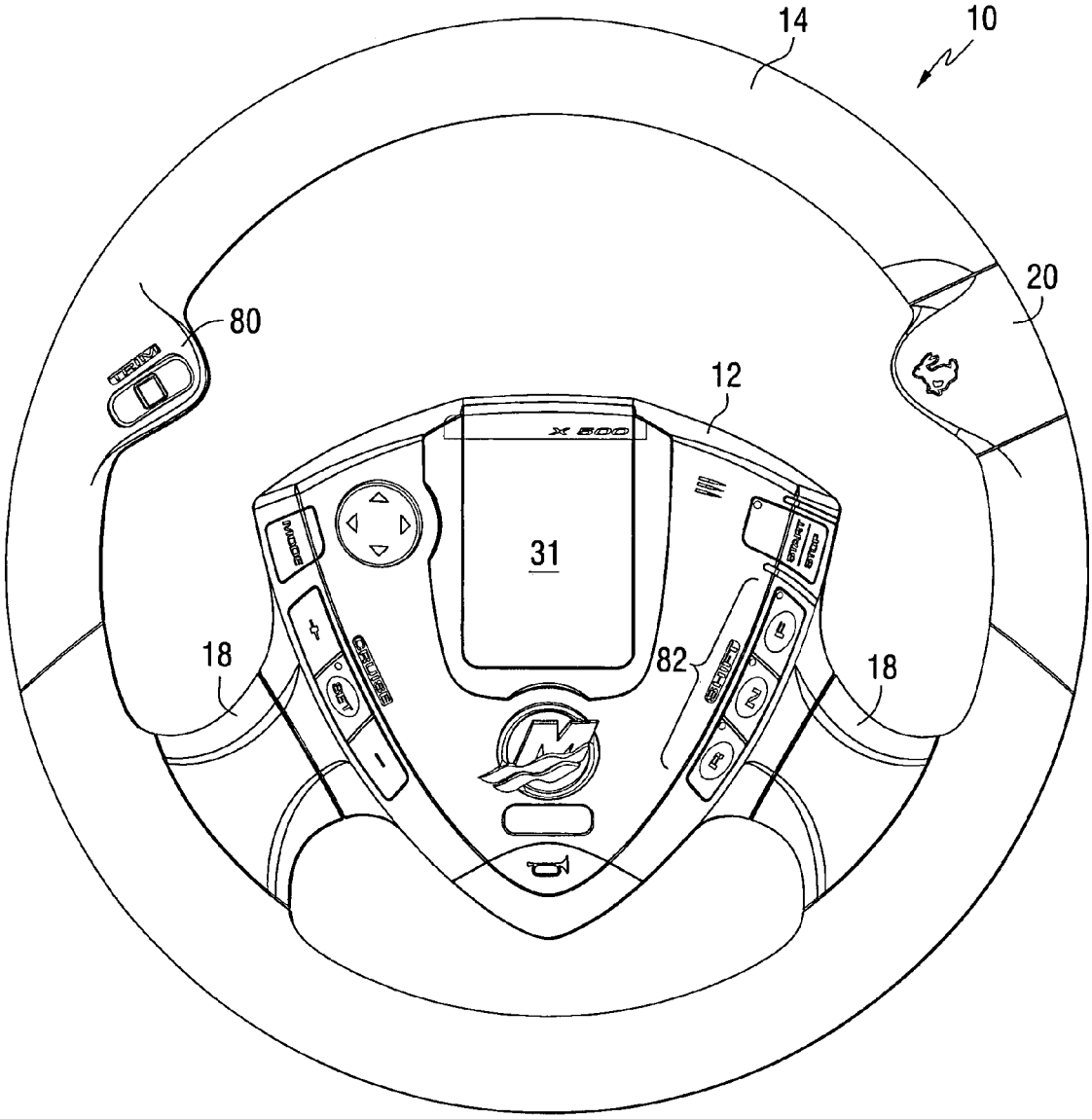
FIG. 6 is a representation of a steering wheel made in accordance with a preferred embodiment of the present invention.

FIG. 6 shows a steering wheel 10 made in accordance with a preferred embodiment of the present invention. The control device 20 is illustrated at the similar position, relative to the rim 14, shown in FIGS. 1 and 2. This allows the operator to manipulate the position of the control device 20 with a thumb of the hand which is used to grip the rim 14 in the region of the control device 20. The hub 12 is shown connected to the rim 14 with the two members identified by reference numerals 18. In addition to the throttle control device in the upper right hand portion of the rim 14, the embodiment of the present invention shown in FIG. 6 also comprises trim control switches 80, gear shift control buttons 82, and several other control switches associated with the hub 12.

A steering wheel 10 for a marine vessel, made in accordance with a preferred embodiment of the present invention, comprises a hub 12 which is attachable to a steering column 64 of a marine vessel 60, a rim 14 which is attached to the hub 12, and a control device 20 which is movably attached to the rim 14. The control device 20 is configured to provide a signal which is representative of an operational parameter of the marine vessel 60. The control device 20 is rotatable about an axis of rotation 24 which is generally parallel to a line 44 which is tangent to a centerline 26 of the rim 14 in a region where the control device 20 is attached to the steering wheel 10.

Although the present invention has been described in considerable detail and illustrated to show a preferred embodiment, it should be understood that alternative embodiments are also within its scope.

We claim:

1. A steering wheel for a marine vessel, comprising:

a hub which is attachable to a steering column of said marine vessel for rotation about a steering axis;

a rim which is attached to said hub and having a centerline extending arcuately about said steering axis; and a control device which is rotatably attached to said rim, said control device being configured to provide a signal which is representative of an operational parameter of said marine vessel, said control device having a surface extending therefrom as a lever engageable and actuatable by a finger of an operator to rotate said control device, said control device being rotatable about a rotation axis which is generally parallel to a line which is tangent to said centerline of said rim in a region where said control device is attached to said rim.

2. The steering wheel of claim 1, wherein:

said control device is rotatable about an axis of rotation, and said surface extends along a plane which transversely crosses an arc of rotation about said axis such that said surface constitutes said lever and is engageable by a single said finger of the operator to rotate said control device without an additional finger or palm having to grip said control device to rotate same, whereby the remaining fingers and palm of the operator can remain in engagement with said rim.

3. The steering wheel of claim 2, wherein:

said single finger is the thumb of the operator.

4. The steering wheel of claim 2 wherein said surface extends radially beyond the cross-sectional profile of said rim to a sufficient radial extension to constitute said lever and enable engagement and actuation by said single finger to rotate said control device about said axis.

5. The steering wheel of claim 4, further comprising:

an information display device attached to said hub and configured to display information relating to said operational parameter of said marine vessel.

6. The steering wheel of claim 5, wherein:

said rim is generally circular.

7. The steering wheel of claim 6, wherein:

said control device is configured to return to a central position unless a force is exerted to move said control device away from said central position.

8. A steering wheel for a marine vessel, comprising:

a hub which is attachable to a steering column of said marine vessel for rotation about a steering axis;

a rim which is attached to said hub and having a centerline extending arcuately about said steeling axis;

a control device which is rotatably attached to said rim, said control device being configured to provide a signal which is representative of an operational parameter of said marine vessel, said control device being rotatable about a rotation axis which is generally parallel to and spaced from a line which is tangent to said centerline of said rim in a region where said control device is attached to said rim, said control device having a surface extending therefrom as a lever engageable and actuatable by a finger of an operator to rotate said control device;

a communication bus connected in signal communication with said control device, and an actuator which is configured to affect said operational parameter of said marine vessel;

an information display device attached to said hub and configured to display information relating to said operational parameter of said marine vessel.

9. The steering wheel of claim 8, wherein:

said control device is configured to return to a central position unless a force is exerted to move said control device away from said central position.

10. The steering wheel of claim 9, wherein:

said control device is a throttle control device which comprises a potentiometer.

11. The steering wheel of claim 8, wherein:

said line which is tangent to said centerline of said rim is spaced from said axis of rotation along a first radial direction;

said control device has a surface extending radially therefrom along a second radial direction and constituting a lever engageable and actuatable by a finger of an operator to rotate said control device about said axis of rotation, said second radial direction being opposite to said first radial direction.

* * * * *